US007062806B2

(12) United States Patent
Merlin

(10) Patent No.: US 7,062,806 B2
(45) Date of Patent: Jun. 20, 2006

(54) BEDDING STRUCTURE WITH IMPROVED DOOR/TRACKING SYSTEM

(76) Inventor: Katherine Merlin, 1500 North Congress Ave., West Palm Beach, FL (US) 33401

( * ) Notice: Subject to any disclaimer, the term of this patent is extended or adjusted under 35 U.S.C. 154(b) by 0 days.

(21) Appl. No.: 11/052,713

(22) Filed: Jan. 31, 2005

(65) Prior Publication Data

US 2005/0241065 A1 Nov. 3, 2005

Related U.S. Application Data

(60) Provisional application No. 60/566,122, filed on Apr. 28, 2004.

(51) Int. Cl.
*A47C 29/00* (2006.01)
*A47D 7/00* (2006.01)
*A47D 13/00* (2006.01)

(52) U.S. Cl. ..... 5/93.1; 5/98.1; 5/414; 160/201; 160/371

(58) Field of Classification Search ..... 5/93.1, 5/98.1, 414; 312/210, 297; 160/36, 37, 160/352, 201, 273.1, 371
See application file for complete search history.

(56) References Cited

U.S. PATENT DOCUMENTS

| | | | | |
|---|---|---|---|---|
| 1,211,762 | A | 1/1917 | Sawyer | |
| 1,290,585 | A | 1/1919 | Lafferty | |
| 2,555,160 | A | 5/1951 | Schwarz | |
| 4,279,454 | A * | 7/1981 | Koiso et al. | 312/297 |
| 4,681,379 | A | 7/1987 | Pillinini | |
| 4,937,902 | A | 7/1990 | Shapiro | |
| 2003/0126680 | A1 | 7/2003 | Stephen | |

FOREIGN PATENT DOCUMENTS

WO WO 98/36666 8/1998

* cited by examiner

*Primary Examiner*—Alexander Grosz
(74) *Attorney, Agent, or Firm*—Akerman Senterfitt

(57) ABSTRACT

The present invention provides a flexible door for use in enclosing a protected area, thus limiting ingress or egress. The invention includes a tracking system for accommodating the door from above and below and has both top and bottom portions. Also a bendable portion that is engageable with both the top and bottom portions of the tracking system is provided. Further, mesh faces can be attached to the bendable portions for the door and can be engageable with the strip-like portions.

3 Claims, 7 Drawing Sheets

BEDDING STRUCTURE WITH IMPROVED DOOR/TRACKING SYSTEM

CROSS REFERENCE TO RELATED APPLICATIONS

The present application claims the priority of U.S. Provisional Patent Application No. 60/566,122, filed on Apr. 28, 2004, which is incorporated herein by reference.

BACKGROUND OF THE INVENTION

Notwithstanding many studies and reports focusing on infant death and injury in cribs, there remains a dramatic need for improved bedding structure to ensure safety for infants and young children and to create a more user friendly environment for the benefit of parents or other care providers.

Various enclosures are known for infant and health care beds which feature mesh and comparable materials to improve safety while also presenting aesthetically acceptable crib and bed units. Difficult access to the bed area presents handling challenges such as extreme bending in reaching down over side structure to lift or lower an infant onto a crib. Suitable closure of mesh-like materials when used with cribs presents a challenge.

U.S. Pat. No. 4,937,902 discloses a crib with moveable doors which form one side of the crib structure. As shown in FIGS. 1 and 3 of U.S. Pat. No. 4,937,902, the doors 30, 32 include materials which are flexible to permit the doors to bend at head sidewall 18 and foot sidewall 20. As shown in FIG. 5 of U.S. Pat. No. 4,937,902, the flexible material comprises a series of slats 56 which include a front face 58, side faces 60, and a rear face 62. Adjacent slats are fastened together at the rear face 62. A flexible backing 64 is used to secure the adjacent rear faces 62 in proper vertical alignment to enable the doors to then be slid around approximately a ninety degree corner to enable them to be housed in the end structure. Upper and lower tracks control the range of the doors.

Other crib designs can also be found, such as U.S. Pat. No. 2,555,160, which is also directed to an infant's crib. An enclosure 12 comprises two end panels 18 and 20, a side frame 22, which is suitably secured by brackets 24 and an opposite side gate 26. Side gate 26 has two sections 28 suitably hinged to the end panels 18 and 20.

U.S. Pat. No. 1,290,585 is directed to an infant's crib which includes an open mesh structure 9 that encloses the crib about framework 10. Two hinged doors 12 are also provided.

U.S. Pat. No. 1,211,762 is directed to a baby bed which utilizes a screen 4 to protect the baby.

All of the above references have shortcomings related to aesthetics, safety, and particularly with respect to the feasibility and handling of small infants.

SUMMARY OF THE INVENTION

It is thus an object of the subject invention to provide an improved bedding structure which is easily accessible yet safe, and which provides easy visibility of the infant from outside of the bedding structure.

It is another object of the subject invention to provide bedding structure that will permit a child to be placed into and taken from the bedding structure without unnecessary bending or reaching.

It is yet another object of the subject invention to provide a bedding structure where there is increased visibility of the child from outside of the bedding structure.

It is but one more object of the subject invention to provide a bedding structure where access can be accomplished in a relatively silent fashion.

These objects can be achieved with the features recited herein. Rather than having to bend over a typical crib by reaching over a high side, the bedding structure provides sliding doors which include a mesh-like material attached to upper and lower slideable members. The upper and lower members may be engaged to a track to enable the doors to be opened by sliding them around a substantially ninety degree corner. Further, the doors can be slid around the perimeter of the bedding structure to allow for multiple access points.

As can be readily understood, each door can be opened for access to place the infant in the bedding structure and then closed once the infant is placed within the bedding structure. Through the use of the mesh material, clear acrylic, and/or Eisenglass, visibility into the bedding structure is achieved at the same time that security is also achieved. The child in the bedding structure is also able to see others in the room without having to look upwardly to be able to see someone who can only be seen when they are directly above the bedding structure's sides. The high mesh sides prevent the child from climbing out.

Safety is greatly enhanced as the subject crib has no bars that could otherwise be injurious to an infant or toddler. Also, no bumper pads are contemplated.

DETAILED DESCRIPTION

Figure 1:
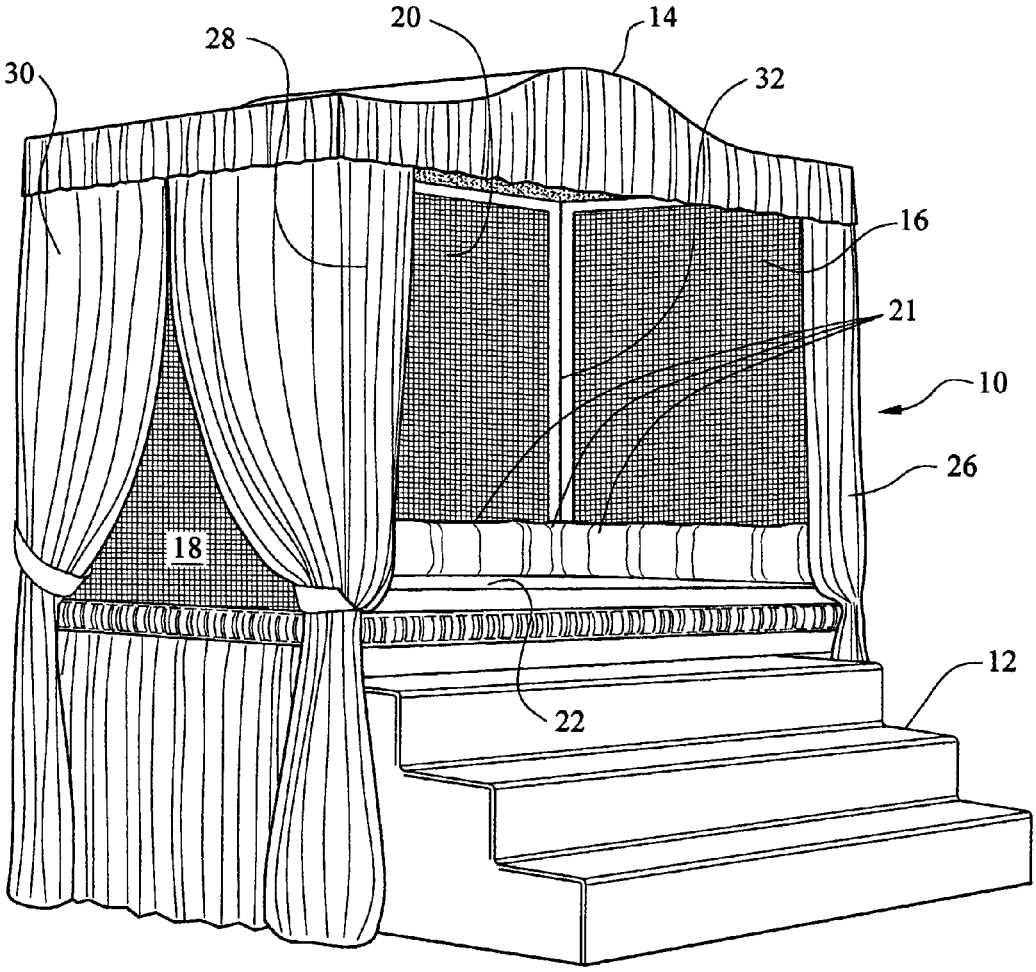
FIG. 1 is a perspective view of the bedding structure with design features which include retractable steps and a canopy.

With reference to FIG. 1, a bedding structure 10 is shown with various added attributes. The bedding structure 10 shows retractable steps 12 and a canopy structure 14 which adds to the aesthetic appearance of the bedding structure 10. End walls 16, 18, and side wall 20 complete three sides of the bedding structure 10. The fourth side, which in FIG. 1 is shown open, features two doors (not shown) which when opened, are closely aligned to end walls 16, 18. A mattress 22 will provide a resting surface. Of the four corner posts that provide structural support for bedding structure 10, only corner post 32 is shown in FIG. 1. Side drapes 26, 28, and 30 can extend downwardly from canopy structure 14 to block out light and noise. In one embodiment, the side drapes 26, 28, and 30 can be attached with hook and loop fasteners for safety and ease of removal for cleaning. Further, the inside surfaces of the corner posts 32 and end walls 16, 18 and 20 can be lined with padding 21, which can also be removably attached with hook and loop fasteners.

Figure 2:
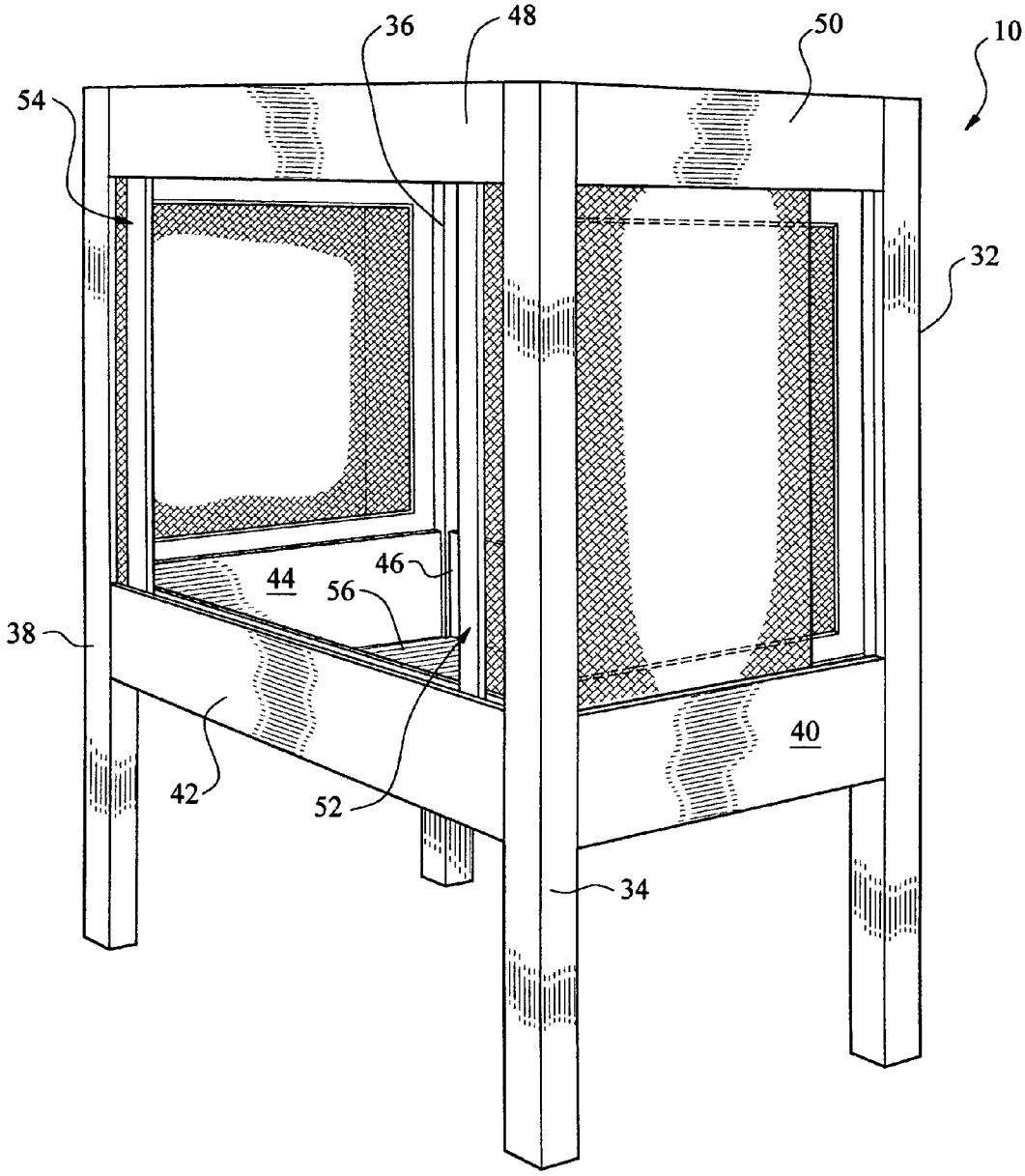
FIG. 2 is a perspective view of the framework of the bedding structure showing its access doors open.

With reference to FIG. 2, the bedding structure 10 is shown in a construction phase with the corner posts 32, 34, 36, and 38 extending downwardly to the floor, as shown by corner posts 32, 34, 36 and 38. Accordingly, the corner posts 32, 34, 36, and 38 provide the support for base 56 of the bedding structure 10. The mattress 22 shown in FIG. 1 will rest on base 56. Additionally, front posts 34 and 38 can be bifurcated (see FIG. 7) to allow the doors 52 and 54 to tunnel through the posts (see FIG. 4). With further reference to FIG. 2, lower side walls 40, 42, 44, and 46 connect the posts 32, 34, 36, and 38 in the same fashion as upper side walls 48, 50. The main frame structure is completed by two additional upper side walls (not shown) connecting posts 32, 34, 36, and 38.

Also shown in FIG. 2, doors 52 and 54, are slideable within tracks (not shown) so as to come together in a closed position, as will be described with respect to FIG. 3. In the retracted position in FIG. 2, the opening between the doors when in the open position, allows access to the inside of the bedding structure 10.

Figure 3:
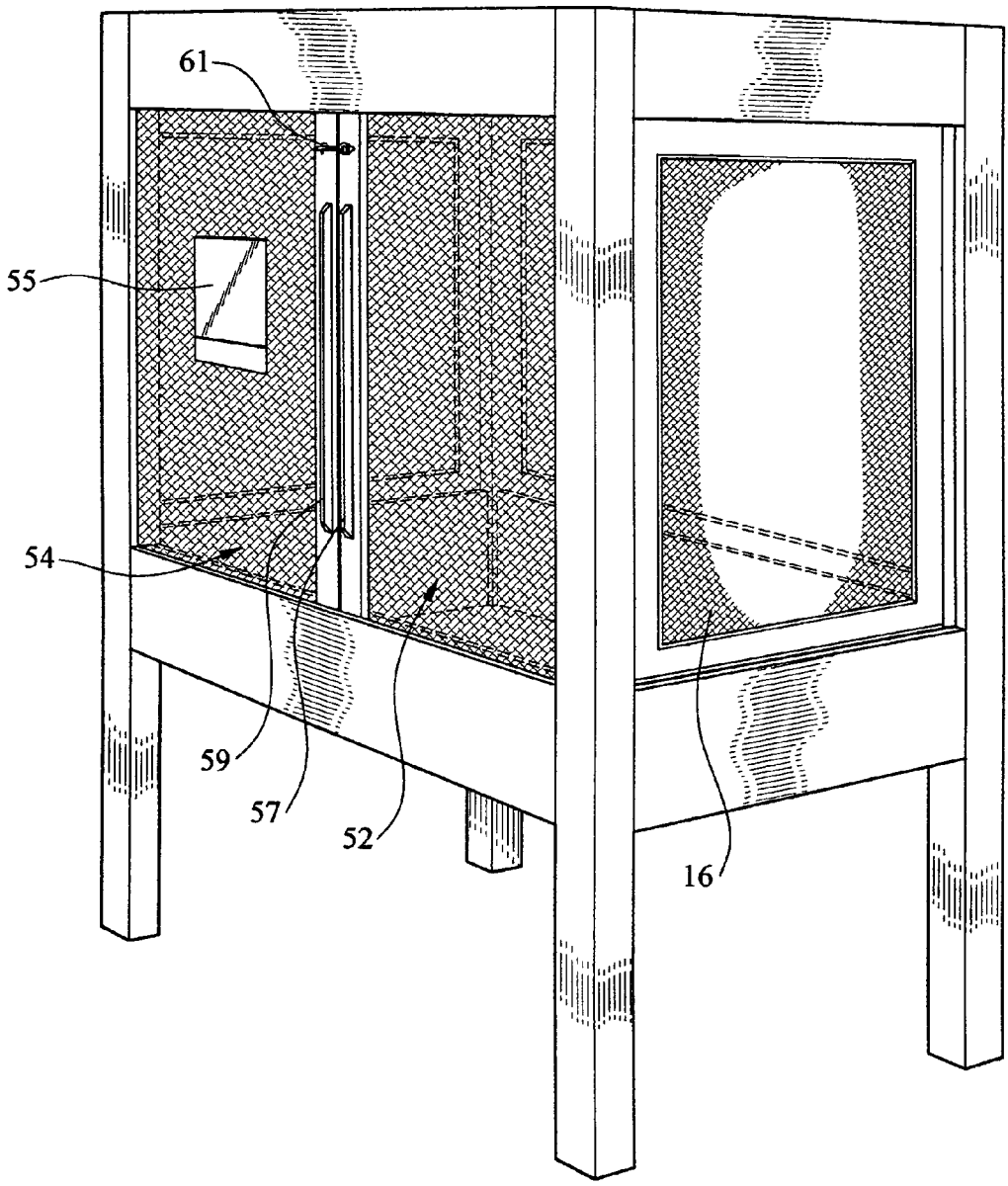
FIG. 3 is a similar perspective view to FIG. 2, showing the framework of the bedding structure but with access doors closed.

As shown in FIG. 3, the doors 52 and 54 can be closed to completely close access to the bedding structure 10. It will be appreciated from FIG. 3 that the side walls of the doors 52, 54 and endwalls 16 may be constructed of mesh material. Windows 55 of clear acrylic, and/or Eisenglass are also contemplated, which allows visual observation within the bedding structure 10, but which provides both closure and safety simultaneously. Also, the doors 52 and 54 can include door handles 57, 59 for grasping during movement. Latch 61, although shown as a hook and eye structure may be a childproof latch as well.

Figure 4:
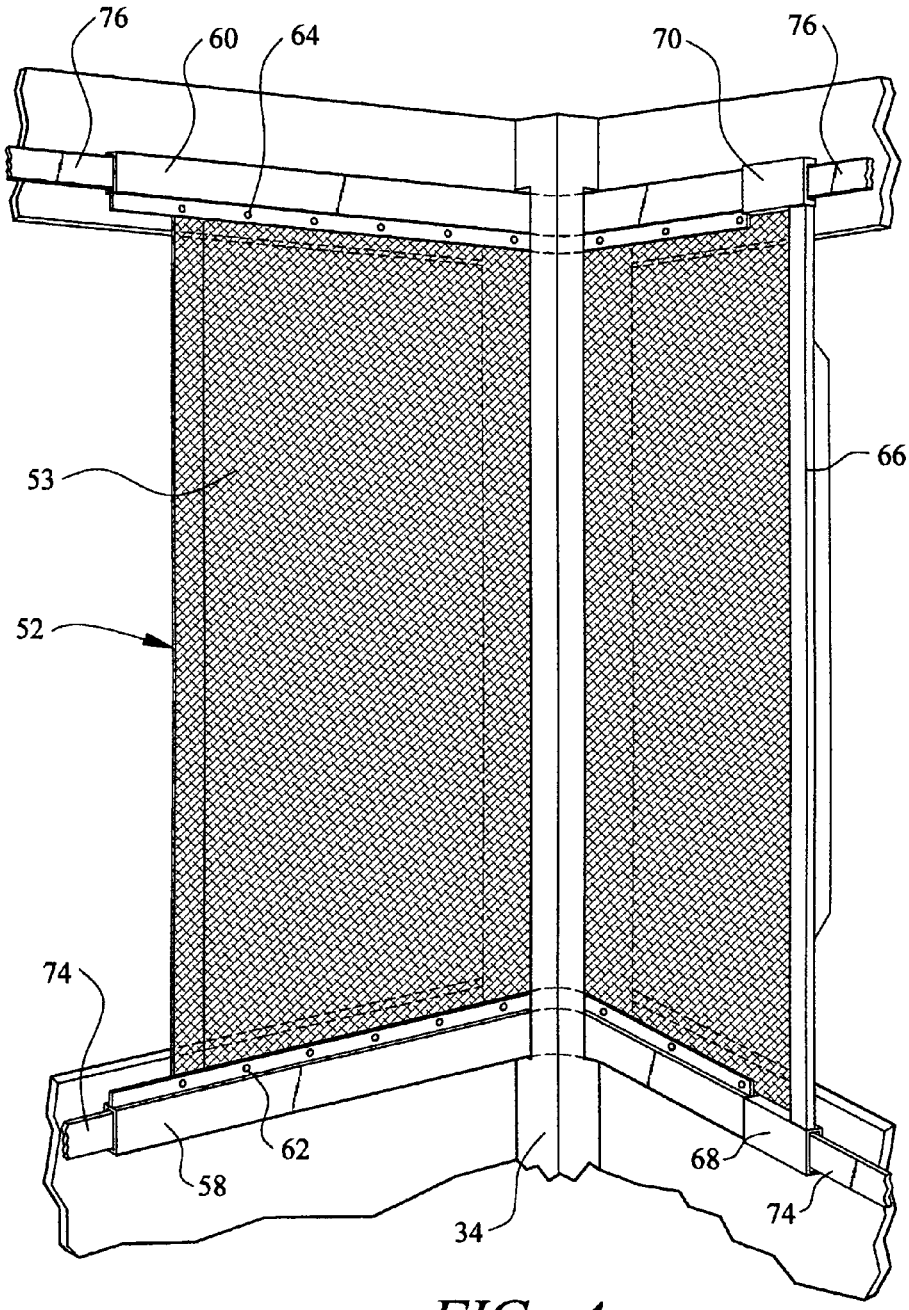
FIG. 4 shows a close-up perspective view taken from inside the bedding structure and which shows a door partially open, thus highlighting the ninety degree turn through which the door moves, as enabled by the accompanying track structure.

As seen from the close-up view of FIG. 4 taken from a perspective within the bedding structure 10, each door 52 includes the side wall of mesh material 53 attached to holders 58, 60 by hook means 62, 64. The holders 58 and 60 can be constructed of plastic or any other suitable flexible and bendable material. The door 54 has side upright 66, which prevents the door from wobbling and acts as a closure extremity with a comparable upright on the mating door (54), such that the uprights come together to provide a tight joinder as the doors are fully closed. Stabilizing blocks 68 and 70 are shown at bottom and top to provide secure closure as they are joined together with comparable structure on the opposing door when the doors are closed.

Figure 5:
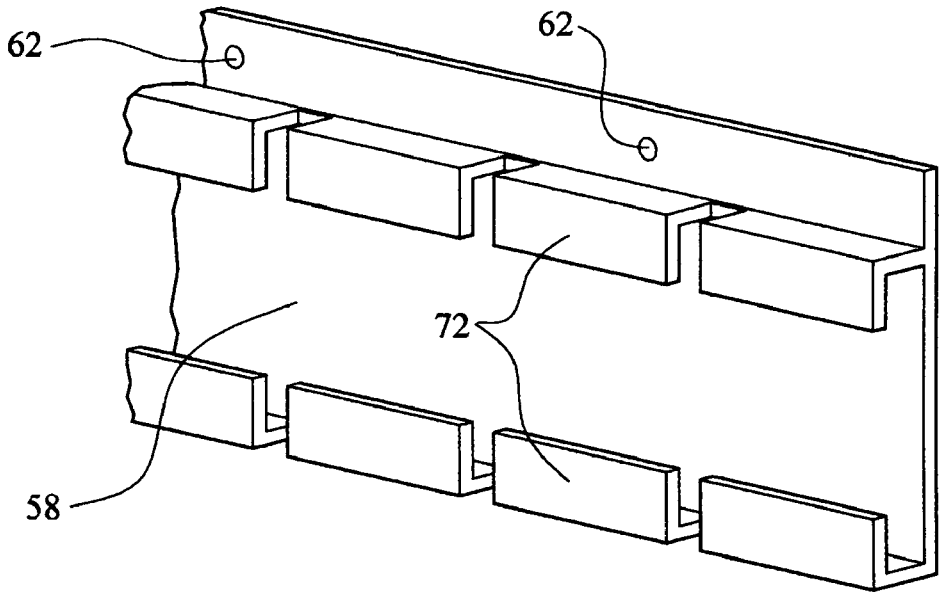
FIG. 5 is a perspective view of a portion of the movable track.

With reference to FIG. 5, the other side of a plastic holder 58 can be seen. The holder 58 has gripping structure 72, which forms a track-like member to engage the stationary mating track members 74 (FIG. 4). The track member 74 extends along the end walls and what serves as a front wall so that the doors can be moved along the perimeter of bedding structure 10. Accordingly, the doors can be moved from their closed position, to the end walls where they are in the open position, and therewith making a ninety degree turn through the bifurcated corner post 34, as best appreciated from FIG. 4. It is to be appreciated that holder 60 has comparable structure to gripping structure 72 (not shown) and that door 54 is constructed in like manner to door 52.

Figure 6:
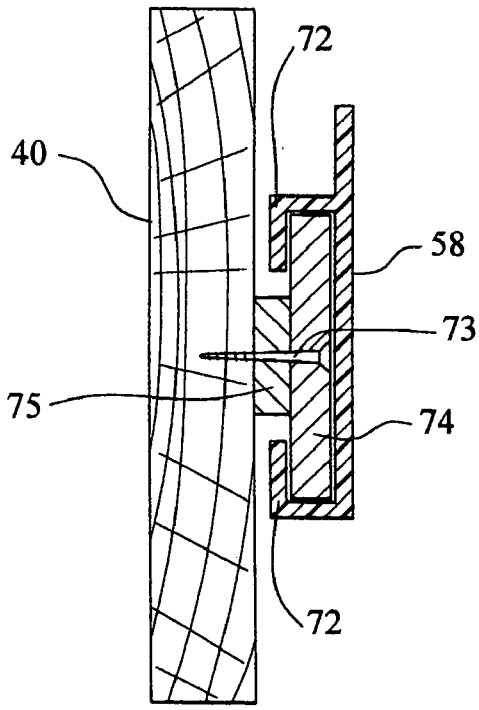
FIG. 6 is a cross-sectional partial side elevation view of the stationary track.

With reference to FIG. 6, cross section view is shown of stationary track 74 which is encompassed by gripping structure 72 of holder 58. Stationary track 74 is attached to lower side wall 40 by fastener 73. Risers 75 create the necessary space between track member 74 and sidewalls such as 40 to allow gripping structure 72 to fit over tracking member 74.

Figure 7:
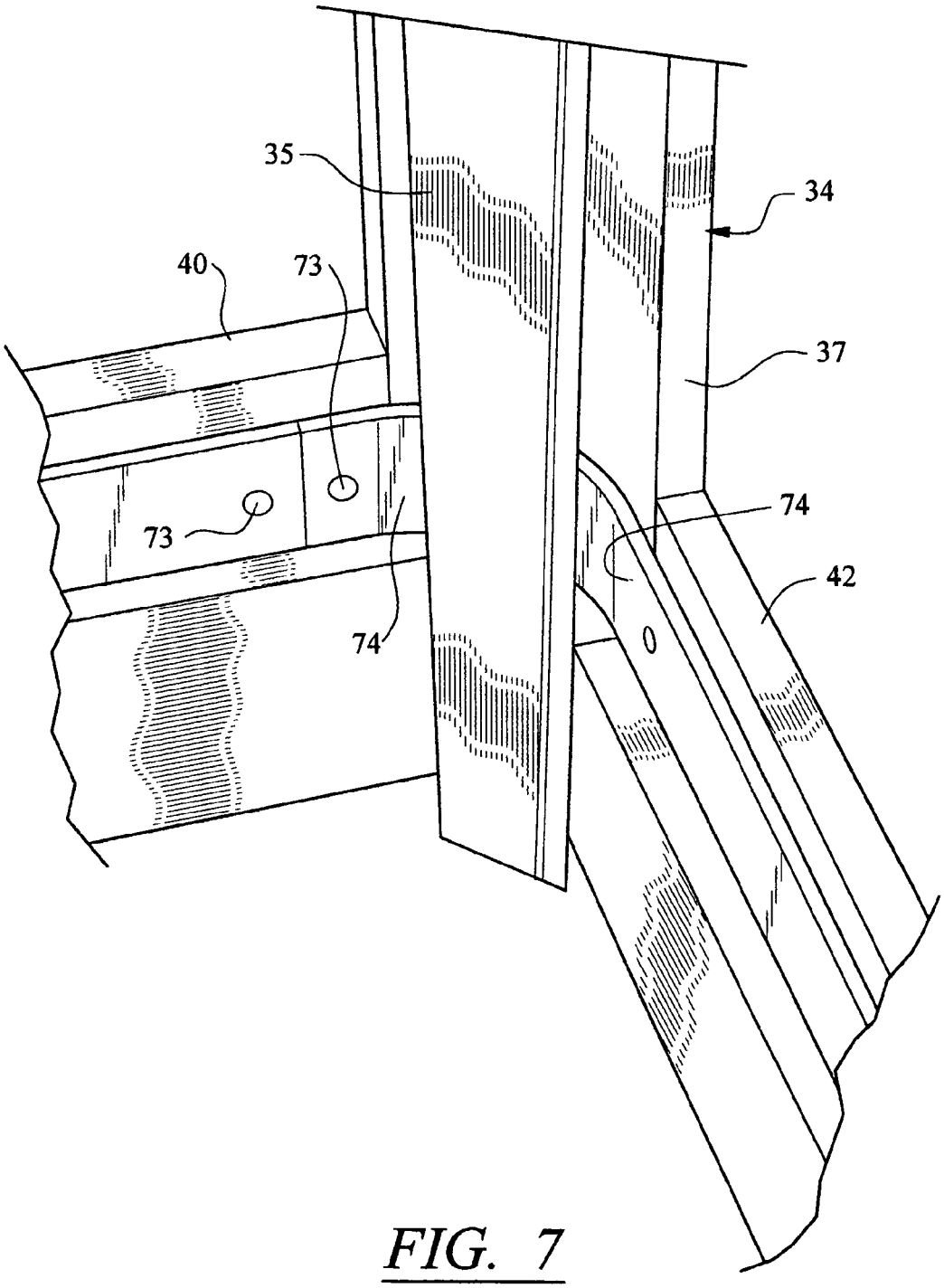
FIG. 7 is a perspective view of a bifurcated corner post shown in the construction phase showing the track member.

FIG. 7 shows the detail of the corner structure for the two posts 34, 38 (not seen in FIG. 7) that are adjacent the opening doors. Each of the two corner posts include bifurcated structure, enter section 35 and enter section 37 which allow the track member 74 to go between as it rounds each of the corners. The track member 74 is attached at periodic spots by fasteners 73 and risers 75 which offset the track member 74 from the sidewall members such as sidewall member 40 (see FIG. 6).

Figure 8:
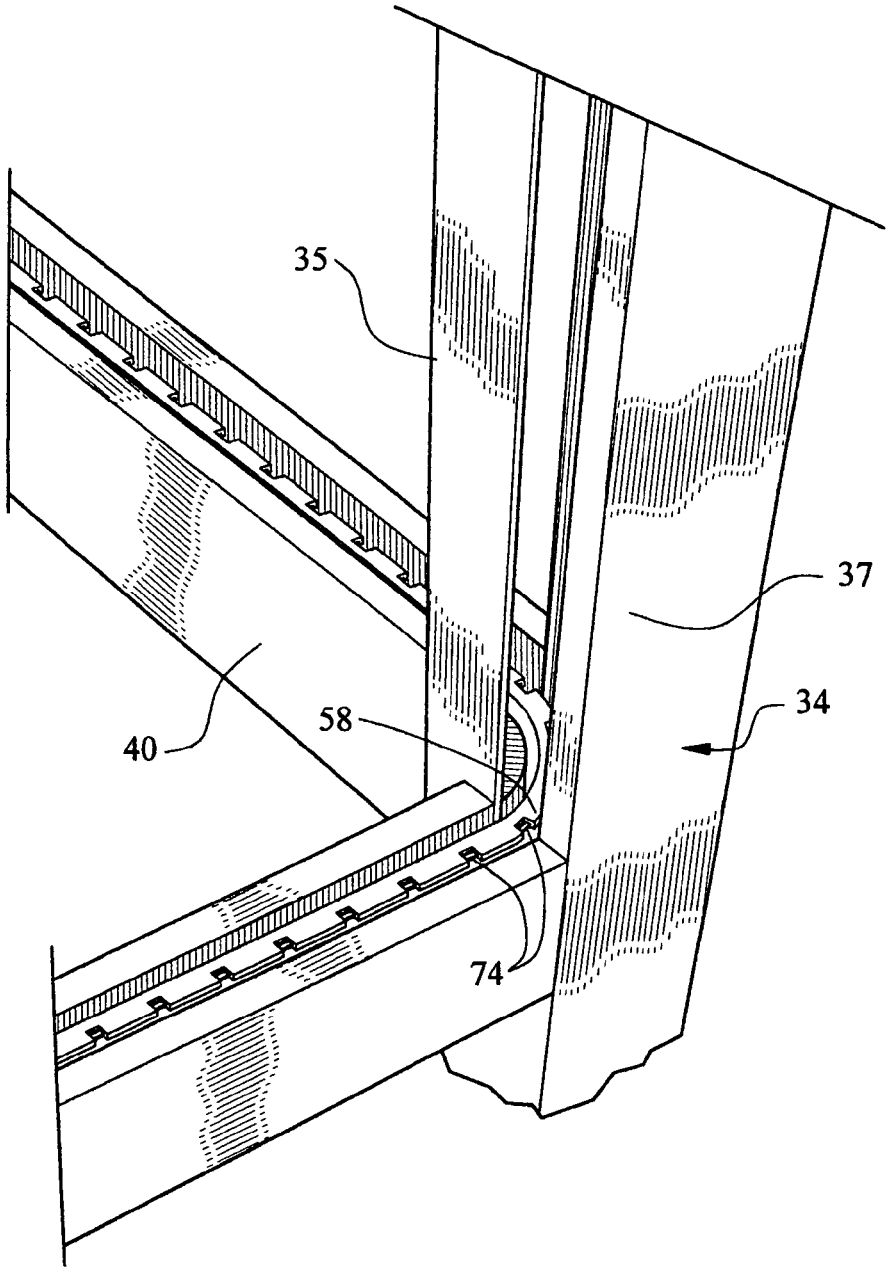
FIG. 8 is a perspective view of a bifurcated corner post in the construction phase showing the mesh holder in place over the track member.

FIG. 8 is similar to FIG. 7, however, the holder 58 is shown encircling the track member 74 but without mesh 53.

It will be appreciated that when the doors 52 and 54 are slid open from their orientation in FIG. 3 to the orientation shown in FIG. 2, access to the bedding structure 10 is enabled so that an infant can be placed in the bedding structure 10 or removed or otherwise cared for by a parent or care provider. As the doors 52 and 54 are closed to the positions shown in FIG. 3, the bedding structure 10 is easily secured so that the baby is safe within, but yet visibly observed through the mesh-like material, clear acrylic, and/or Eisenglass.

In daily operation, it will be appreciated that with this design, safety is greatly enhanced. The mesh material and the removable padding, which can be used on not only the doors, but the end walls and back side walls as well, eliminates the need for dangerous bumper pads and provides a safe environment. Soft material can be used for the mattress and to cover the corner uprights so that there is no danger of the user injuring themselves on hard and/or sharp materials.

The need to bend over an upright side of the bedding structure is eliminated by the doors, which are easily opened and closed, providing the necessary access to the inside of the bedding structure. Side rails do not have to be lowered or raised or otherwise adjusted, as it is much easier to open and close the mesh doors, which greatly increase the ability to effortlessly yet securely present an acceptable bedding structure environment.

It will be appreciated that the present invention may be adapted for utilization beyond the specific environments discussed herein. For instance, although the bedding structure 10 may be used for infants instead of using a crib, the invention is not limited in this regard as such an access providing bedding structure can be used by adults in a variety of settings, such as in a health care facility. Accordingly, the present invention is not limited to the specific embodiments described herein, but is defined by the scope and spirit of the following claims.

I claim:

1. A bedding structure comprising:

a side wall; two opposing end walls; two flexible doors opposite said side wall and acting as closure means between two end walls, with each of said flexible doors being bendable and slidable so as to be in parallel orientation with said end walls, when said flexible doors are in a fully open position, said flexible doors further including mesh material to create closure; and a tracking system for accommodating said flexible doors from above and below, having both top and bottom portions, wherein said tracking system bends through 90 degree angles to allow said flexible doors to open from a closing engagement to a position where said doors are fully open and in a 90 degree orientation to said closing engagement said tracking system including a stationary track above and below said mesh material, and further including a holding member to which said mesh is secured, and a gripping structure, attached to said holding member, slidably engaging and fitted over said stationary tracks.

2. The bedding structure of claim 1, further comprising corner posts adjacent to said end structure, wherein said corner posts are bifurcated to permit the doors to slide there through.

3. A bedding structure of claim 1 further including the use of risers to properly position the tracks for engagement by the gripping structures.

* * * * *